US012429051B2

(12) United States Patent
Seol

(10) Patent No.: US 12,429,051 B2
(45) Date of Patent: Sep. 30, 2025

(54) SINGLE SCREW COMPRESSOR

(71) Applicant: PARALLOID GEAR CO., LTD., Gimpo-si (KR)

(72) Inventor: In Hwan Seol, Seoul (KR)

(73) Assignee: PARALLOID GEAR CO., LTD., Gimpo-si (KR)

( * ) Notice: Subject to any disclaimer, the term of this patent is extended or adjusted under 35 U.S.C. 154(b) by 0 days.

(21) Appl. No.: 18/229,142

(22) Filed: Aug. 1, 2023

(65) Prior Publication Data

US 2024/0044332 A1 Feb. 8, 2024

Related U.S. Application Data

(60) Provisional application No. 63/394,303, filed on Aug. 2, 2022.

(51) Int. Cl.
*F04C 18/16* (2006.01)

(52) U.S. Cl.
CPC ..... *F04C 18/16* (2013.01)

(58) Field of Classification Search
CPC ..... F04C 18/16; F04C 18/52; F04C 18/024; F04C 18/14; F04C 18/107; F04C 21/0827; F04C 2/14; F04C 2/16; F04C 2/082; F04C 2/084; F04C 2240/20; F04C 1/16; F04C 1/084; F25B 1/047; F16H 1/00; F16H 1/16; F16H 1/20; F16H 3/00
See application file for complete search history.

(56) References Cited

U.S. PATENT DOCUMENTS 3,133,695 A * 5/1964 Zimmern ..... F04C 18/52 418/113
3,181,296 A * 5/1965 Zimmern ..... F02B 53/00 60/39.63
4,028,016 A * 6/1977 Keijer, Jan T. ..... F04C 28/14 417/440
2013/0129553 A1* 5/2013 Picouet ..... F04C 18/084 418/195

FOREIGN PATENT DOCUMENTS

KR 10-2007-0008329 A 1/2007
KR 10-1878798 B1 7/2018

OTHER PUBLICATIONS

F.L. Heidrich, Water Flooded Single Screw (SSP) Compressor Technology (1996), International Compressor Engineering Conference, pp. 145-150.

(Continued)

*Primary Examiner* — Dapinder Singh
(74) *Attorney, Agent, or Firm* — Insight Law Group, PLLC; Seung Lee

(57) ABSTRACT

Proposed is a single screw compressor having an independent mechanical rotational force transmission unit between a rotation shaft of a main screw and a rotation shaft of a star wheel. The rotational force transmission unit has the same transfer ratio as a rotation ratio at which the main screw and the star wheel mesh with each other. The rotational force transmission unit may include: a first gear which is a double-enveloping worm that is fixed to the rotation shaft of the main screw to integrally rotate with the main screw and has the same pitch and lead with the main screw; and a worm gear configured to cooperate with the double-enveloping worm.

9 Claims, 2 Drawing Sheets

(56) References Cited

OTHER PUBLICATIONS

Weifeng Wu et al., A Numerical Contour Method for Simulating Spiral Groove Bottom Profiles (Feb. 2012), Journal of Mechanical Design, vol. 134, pp. 024501-1-5.
Non-final Office Action mailed on Oct. 24, 2024 from the Korean Patent Office for Application No. 10-2023-0095611.

* cited by examiner

SINGLE SCREW COMPRESSOR

CROSS-REFERENCE TO RELATED APPLICATION(S)

This application claims priority from U.S. Provisional Application No. 63/394,303, filed on Aug. 2, 2022, the entire contents of which are incorporated herein by reference.

BACKGROUND

1. Field

The present disclosure relates to a single screw compressor (SSC) having a cylindrical main screw which meshes with two planar star-wheels.

2. Description of Related Art

The operation of the Single Screw Compressor (SSC) is described in Heidrich, F. L., 1996, "Water Flooded Single Screw (SSP) Compressor Technology", Purdue Compressor Technology Conference, Purdue, pp. 145-150. Compression occurs in the volume created when the star-wheels mesh with the main screw. This volume, along with tight screw to housing clearances, forms a compression chamber. The cycle begins as suction gas is drawn through the front of the compressor and fills the exposed grooves of the main screw. As the screw rotates, the gas becomes trapped among the three sides of the main screw, the cylindrical casing, and the star-wheels.

For high efficiency, sealing performance between the star-wheel tooth and the spiral groove is very important, because it is sensitive to the flowrate of the compressor. For this reason, the tooth tip profile is designed according to the profile of the spiral groove bottom to make sure that the tooth tip can hermetically mesh with the groove bottom with enough small clearances between them. Wu, Weifeng & Sun, Shuo & Feng, Quanke. (2012), "A Numerical Contour Method for Simulating Spiral Groove Bottom Profiles", Journal of Mechanical Design. 134. 10.1115/1.4005598 discloses a scheme for the design. This design requires tedious iterative numerical analysis, and as exemplified in detail in the above paper, machining according to the design drawing may reach an imperfect result.

In the conventional SSC, the rotation of the star wheel follows the rotation of the main rotor by direct contact between the groove of the main rotor and the teeth of the star wheel. This structure cannot avoid contact between the groove of the main screw and the teeth of the star wheel. This contact causes friction and wear.

Errors caused by imperfect design and imperfect machining cause excessive friction and wear, which requires cooling and lubrication with water or oil. These added cooling/lubrication structures result in contamination of the compressed process gas, thus limiting the field of application or requiring additional filtering.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

The present disclosure is directed to providing a single screw compressor (SSC) that does not require cooling or lubrication despite errors in design or machining.

According to one aspect, a rotational force transmission unit is additionally provided between a rotation shaft of a star wheel and a rotation shaft of a main screw of an SSC.

The rotational force transmission unit may have the same transfer ratio as a rotation ratio at which the main screw and the star wheel mesh with each other.

According to another aspect, the additional rotational force transmission unit may include a first gear fixed to the rotation shaft of the main screw, a second gear configured to transmit a rotational force of the first gear while having a rotation shaft perpendicular to a shaft of the first gear, a third gear fixed to a rotation shaft of a star wheel, and a parallel shaft power transmission unit configured to transmit power between the second gear and the third gear.

According to another aspect, the first gear may be a double-enveloping worm fixed to the rotation shaft of the main screw, and the second gear may be a worm gear cooperating with the double-enveloping worm. In an embodiment, the double-enveloping worm may be integrally formed with the rotation shaft of the main screw.

According to another aspect of the present disclosure, the first gear may be a double-enveloping worm having the same pitch and lead with the main screw.

Other features and aspects will be apparent from the following detailed description, the drawings, and the claims.

Figure 1:
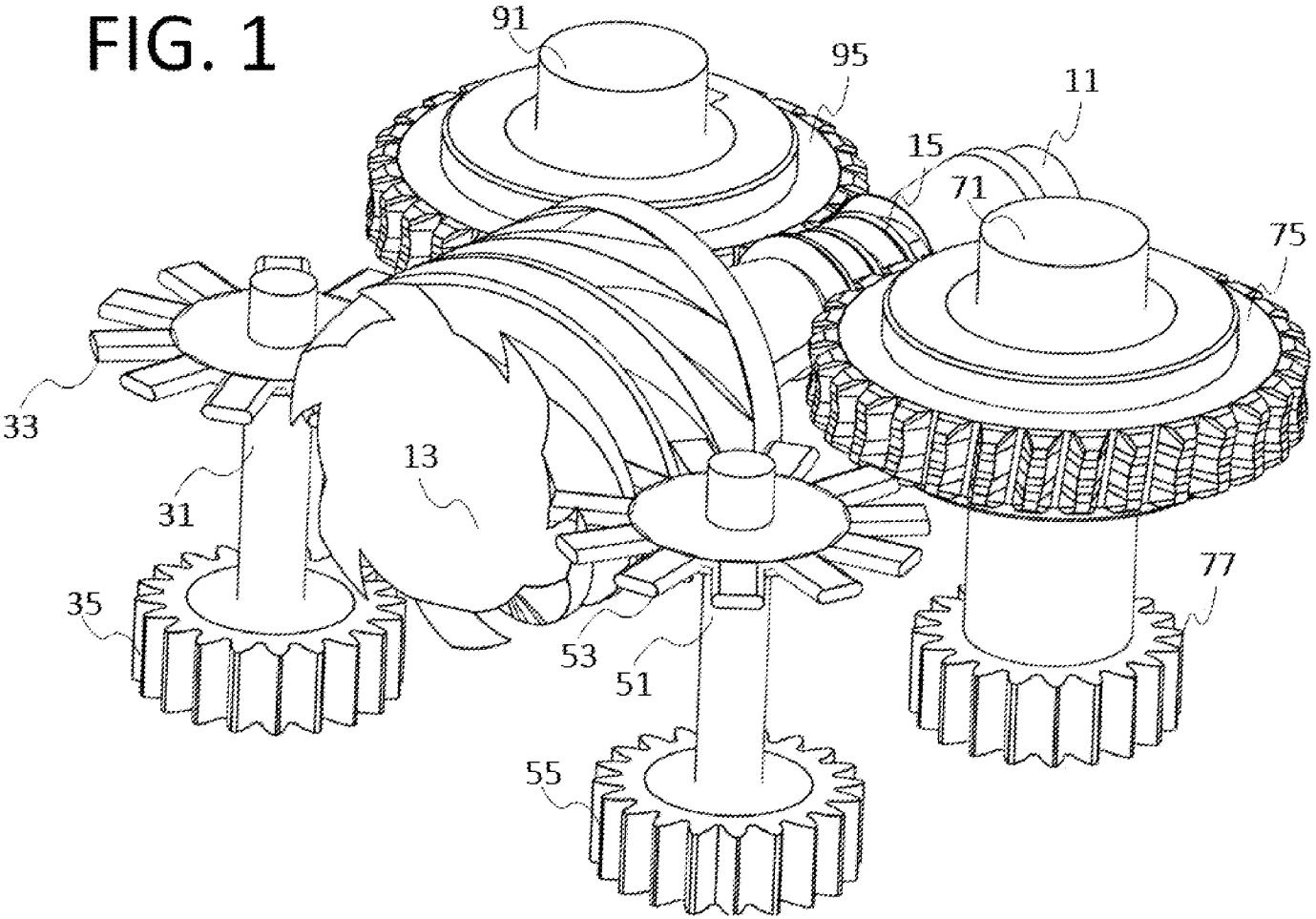
FIGS. 1 and 2 are perspective views illustrating the exterior of a single screw compressor (SSC) according to an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The above-described and additional aspects are embodied through embodiments described herein with reference to the accompanying drawings. It should be understood that components of each embodiment may be combined in various ways within one embodiment or with components of another embodiment unless mentioned otherwise or contradictory to each other. Terms used in the present specification and the claims should be interpreted as having meanings and concepts consistent with the description or proposed technical spirit based on the principle that the inventor may appropriately define the concept of a term in order to describe his or her invention in the best possible way. Hereinafter, exemplary embodiments of the present disclosure will be described in detail with reference to the accompanying drawings.

Figure 2:
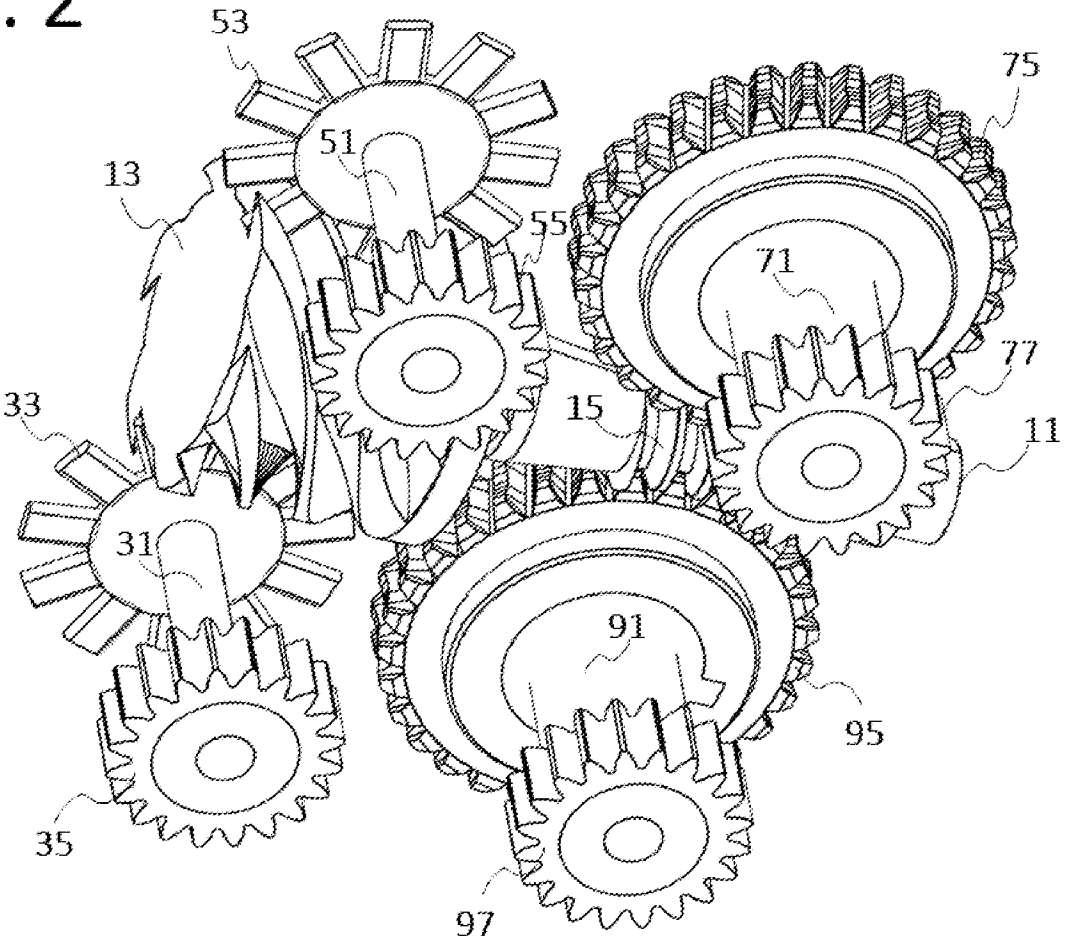

FIGS. 1 and 2 are perspective views illustrating the exterior of a single screw compressor (SSC) according to an embodiment. In the SSC according to the illustrated embodiment, a main screw 13 and a pair of star wheels 33 and 53 are components of a typical SSC. According to an aspect of the present disclosure, an additional rotational force transmission unit is provided between rotation shafts 31 and 51 of the star wheel 33 and 53 and a rotation shaft 11 of the main screw 13 of the SSC. According to an aspect, the rotational force transmission unit has the same transfer ratio as a rotation ratio at which the main screw and the star wheel mesh with each other. In this way, the main screw and the star wheel may indirectly cooperate mechanically through the rotational force transmission unit without compressing a fluid through direct contact with each other, and direct mechanical contact may be flexibly designed through the rotational force transmission unit.

According to another aspect, at the right side of FIG. 1, the additional rotational force transmission unit includes a first gear 15 which is a worm that is fixed to the rotation shaft of the main screw to integrally rotate with the main screw and has the same pitch and lead with the main screw. In order to smoothly transmit the rotation of the main screw as is, it is advantageous in terms of design to make teeth of the first gear 15 have the pitch and lead that correspond to the pitch and lead of teeth of the main screw. According to an additional aspect, the first gear 15 may be a double-enveloping worm in an embodiment. Since the main screw of the SSC may be viewed as mechanically equivalent to the double-enveloping worm, by designing the pitch and lead of the first gear 15 to be the same as the pitch and lead of the main screw, a driving force of the main screw 13 can be more accurately transmitted to the star wheels 33 and 53.

According to another aspect, the double-enveloping worm may be integrally formed with the rotation shaft of the main screw. For example, one end of a single cylindrical metal steel material may be cut to form the main screw 13, and the other end thereof may be form-rolled to form the first gear 15.

In addition, the rotational force transmission unit may include a second gear 75 configured to transmit the rotational force of the first gear 15 while having a rotation shaft 71 perpendicular to the rotation shaft 11 of the first gear 15 and parallel shaft power transmission units 55 and 77 configured to transmit the rotation of the second gear 75 to the rotation shaft 51 of the star wheel 53. In an embodiment, the second gear 75 may be a worm gear 75 engaged with the worm 15.

For example, the parallel shaft power transmission units may be a pair of chain gears connected to each other by a chain. As another example, the parallel shaft power transmission units include a fourth gear 77 fixed to the rotation shaft 71 of the second gear 75 to integrally rotate with the second gear 75 and a third gear 55 fixed to the rotation shaft 51 of the star wheel 53 to integrally rotate with the star wheel 53 and rotate to be mechanically dependent to the rotation of the fourth gear 77.

In an embodiment, the third gear 55 and the fourth gear 77 may be directly engaged with each other. In another embodiment, the parallel shaft power transmission units may further include at least two gears between the third gear 55 and the fourth gear 77. By the additional gears, rotation for smooth cooperation between the main screw 13 and the star wheel 53 may be adjusted.

According to the present disclosure, the rotation of a star wheel follows the rotation of a main rotor by a separate rotational force transmission unit instead of direct contact between a groove of the main rotor and teeth of the star wheel. Accordingly, the direct contact between the groove of the main rotor and the teeth of the star wheel can be minimized. Also, by transmitting power through a double-enveloping worm having a structure equivalent to the structure of the main screw, operation precision can be improved.

The present disclosure has been described above using embodiments with reference to the accompanying drawings, but the present disclosure is not limited thereto and should be interpreted as encompassing various modifications that may be self-evidently derived by those of ordinary skill in the art. The appended claims are intended to encompass such modifications.

What is claimed is:

1. A single screw compressor comprising a main screw and a pair of star wheels configured to mesh with the main screw to compress a fluid, the single screw compressor further comprising a mechanical rotational force transmission unit disposed between a rotation shaft of one of the pair of star wheels and a rotation shaft of the main screw of the single screw compressor and configured to allow the one of the pair of star wheels to rotate synchronously with the main screw without direct contact between the main screw and the one of the pair of star wheels.

2. The single screw compressor of claim 1, wherein the rotational force transmission unit has the same transfer ratio as a rotation ratio at which the main screw and the star wheel mesh with each other.

3. The single screw compressor of claim 2, wherein the rotational force transmission unit includes a first gear which is a worm that is fixed to the rotation shaft of the main screw to integrally rotate with the main screw and has the same pitch and lead with the main screw.

4. The single screw compressor of claim 3, wherein the first gear is a double-enveloping worm fixed to the rotation shaft of the main screw.

5. The single screw compressor of claim 4, wherein the double-enveloping worm is integrally formed with the rotation shaft of the main screw.

6. The single screw compressor of claim 3, wherein the rotational force transmission unit further includes:

a second gear which is a worm gear configured to transmit a rotational force of the first gear while having a rotation shaft perpendicular to a shaft of the first gear; and parallel shaft power transmission units configured to transmit rotation of the second gear to the rotation shaft of the star wheel.

7. The single screw compressor of claim 6, wherein the parallel shaft power transmission units include:

a fourth gear fixed to the rotation shaft of the second gear to integrally rotate with the second gear; and a third gear fixed to the rotation shaft of the star wheel to integrally rotate with the star wheel and rotate to be mechanically dependent to the rotation of the fourth gear.

8. The single screw compressor of claim 7, wherein the third gear and the fourth gear are directly engaged with each other.

9. The single screw compressor of claim 8, wherein the parallel shaft power transmission units further include at least two gears between the third gear and the fourth gear.

* * * * *